US008854213B2

(12) United States Patent
Adstedt et al.

(10) Patent No.: US 8,854,213 B2
(45) Date of Patent: Oct. 7, 2014

(54) BEVERAGE CONTAINER AUTHENTICITY AND PROVENANCE DEVICES AND METHODS

(76) Inventors: Kjell Roland Adstedt, Scottsdale, AZ (US); Joakim Alexander Sternberg, Edina, MN (US)

( * ) Notice: Subject to any disclaimer, the term of this patent is extended or adjusted under 35 U.S.C. 154(b) by 115 days.

(21) Appl. No.: 13/110,839

(22) Filed: May 18, 2011

(65) Prior Publication Data

US 2011/0215160 A1 Sep. 8, 2011

Related U.S. Application Data

(63) Continuation of application No. 12/813,243, filed on Jun. 10, 2010, now abandoned, which is a continuation of application No. 12/035,803, filed on Feb. 22, 2008, now abandoned.

(51) Int. Cl.

| | |
|---|---|
| ***G08B 13/14*** | (2006.01) |
| ***B65D 41/00*** | (2006.01) |
| ***B65D 39/00*** | (2006.01) |
| *G08B 21/00* | (2006.01) |
| *G08B 23/00* | (2006.01) |

(52) U.S. Cl.

CPC ..... *B65D 41/00* (2013.01); *B65D 2203/02* (2013.01); *B65D 2203/10* (2013.01); *B65D 39/00* (2013.01)

USPC ..... 340/572.8; 340/568.1; 340/540; 340/500

(58) Field of Classification Search

USPC ..... 340/568.1, 540, 500, 572.8

See application file for complete search history.

(56) References Cited

U.S. PATENT DOCUMENTS

| | | | |
|---|---|---|---|
| 5,732,979 | A | 3/1998 | Finke et al. |
| 6,050,622 | A | 4/2000 | Gustafson |
| 6,137,413 | A | 10/2000 | Ryan, Jr. |
| 6,226,619 | B1 | 5/2001 | Halperin et al. |
| 6,360,208 | B1 | 3/2002 | Ohania et al. |
| 6,501,435 | B1 | 12/2002 | King et al. |
| 6,641,052 | B2 | 11/2003 | Baillod et al. |
| 6,828,941 | B2 | 12/2004 | King et al. |

(Continued)

FOREIGN PATENT DOCUMENTS

| | | |
|---|---|---|
| JP | 2006194947 | 7/2006 |
| KR | 20-0252202 | 10/2001 |

OTHER PUBLICATIONS

Non-Final Office Action mailed Jan. 5, 2010, U.S. Appl. No. 11/837,462.

(Continued)

*Primary Examiner* — Jennifer Mehmood
*Assistant Examiner* — Omar Casillashernandez
(74) *Attorney, Agent, or Firm* — McKenna Long & Aldridge, LLP

(57) ABSTRACT

An RFID label comprising an RFID circuit and an RFID antenna, and optional secondary security label ensures the authenticity of a beverage contained in a beverage container. The RFID label cannot be removed without destroying the RFID label or rendering it inoperable. A secondary security label may be placed over the closure of the beverage container to provide a secondary measure against tampering as well as a visual indicator of authenticity. It is placed on a portion of the bottle, a portion of the beverage container's closure, and the RFID label. An attempt to remove the secondary security label will also render the RFID label unusable.

8 Claims, 3 Drawing Sheets

(56) References Cited

U.S. PATENT DOCUMENTS

| | | | | |
|---|---|---|---|---|
| 6,888,509 | B2 | 5/2005 | Atherton | |
| 6,891,474 | B1 | 5/2005 | Fletcher | |
| 6,952,157 | B1 | 10/2005 | Stewart et al. | |
| 7,017,807 | B2 * | 3/2006 | Kipp et al. | 235/385 |
| 7,025,263 | B2 | 4/2006 | Kocott | |
| 7,034,689 | B2 | 4/2006 | Teplitxky et al. | |
| 7,040,532 | B1 | 5/2006 | Taylor et al. | |
| 7,048,179 | B2 | 5/2006 | Claessens | |
| 7,061,382 | B2 | 6/2006 | Claessens et al. | |
| 7,126,479 | B2 * | 10/2006 | Claessens et al. | 340/572.1 |
| 7,374,102 | B2 | 5/2008 | Arnold et al. | |
| 7,486,188 | B2 * | 2/2009 | Van Alstyne | 340/572.1 |
| 2002/0178107 | A1 | 11/2002 | Biancavilla | |
| 2004/0148117 | A1 | 7/2004 | Kirshenbaum et al. | |
| 2005/0003839 | A1 | 1/2005 | Tripp | |
| 2005/0051624 | A1 | 3/2005 | Kipp et al. | |
| 2005/0102189 | A1 | 5/2005 | Lopez et al. | |
| 2005/0144132 | A1 | 6/2005 | Lin | |
| 2005/0187827 | A1 | 8/2005 | Weiss et al. | |
| 2005/0248455 | A1 | 11/2005 | Pope | |
| 2005/0261963 | A1 | 11/2005 | McLaughlin et al. | |
| 2006/0017571 | A1 | 1/2006 | Arnold et al. | |
| 2006/0095343 | A1 | 5/2006 | Clarke et al. | |
| 2006/0113369 | A1 | 6/2006 | Taylor | |
| 2006/0113370 | A1 | 6/2006 | Taylor et al. | |
| 2006/0113374 | A1 | 6/2006 | Taylor | |
| 2006/0120752 | A1 | 6/2006 | McVicker et al. | |
| 2006/0132311 | A1 | 6/2006 | Kruest | |
| 2006/0261950 | A1 | 11/2006 | Arneson et al. | |
| 2006/0290496 | A1 | 12/2006 | Peeters | |
| 2007/0008121 | A1 | 1/2007 | Hart | |
| 2007/0050370 | A1 | 3/2007 | Denny | |
| 2007/0055576 | A1 | 3/2007 | Wayman | |
| 2007/0069895 | A1 | 3/2007 | Koh | |
| 2007/0118436 | A1 | 5/2007 | McDowell et al. | |
| 2007/0130090 | A1 | 6/2007 | Staib et al. | |
| 2007/0150369 | A1 | 6/2007 | Zivin | |
| 2007/0187266 | A1 | 8/2007 | Porter et al. | |
| 2007/0296599 | A1 | 12/2007 | Wang et al. | |
| 2007/0299743 | A1 | 12/2007 | Staib et al. | |

OTHER PUBLICATIONS

Final Office Action mailed Sep. 2, 2010, U.S. Appl. No. 11/837,462.

Non-Final Office Action mailed Aug. 2, 2010, U.S. Appl. No. 11/837,465.

Non-Final Office Action mailed Oct. 7, 2009, U.S. Appl. No. 11/840,156.

Non-Final Office Action mailed Sep. 24, 2010, U.S. Appl. No. 12/718,890.

Non-Final Office Action mailed Dec. 11, 2009, U.S. Appl. No. 12/035,803.

Non-Final Office Action mailed Nov. 19, 2010, U.S. Appl. No. 12/813,243.

* cited by examiner

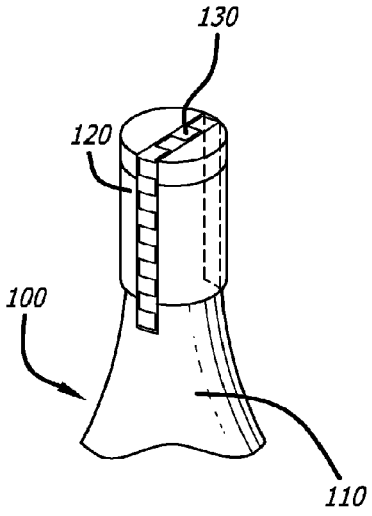
FIG. 1
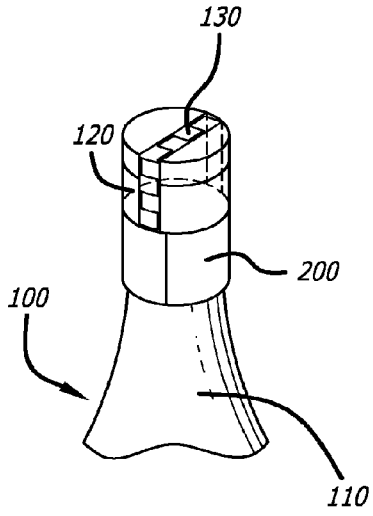
FIG. 2
FIG. 3
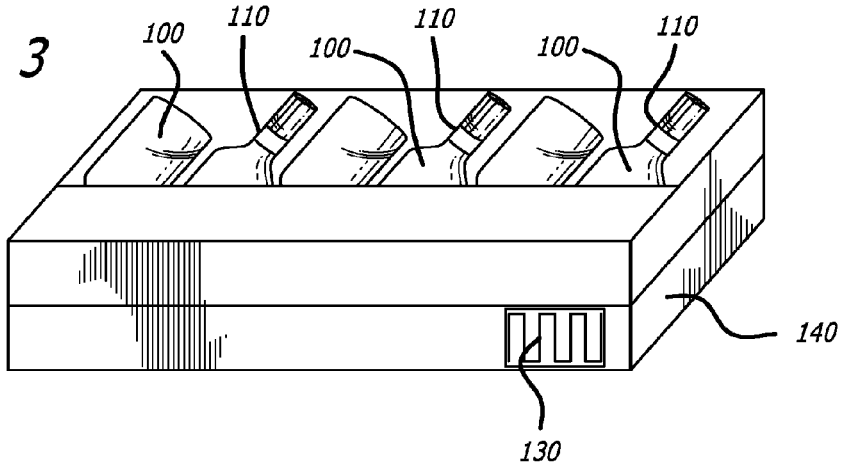

BEVERAGE CONTAINER AUTHENTICITY AND PROVENANCE DEVICES AND METHODS

RELATED APPLICATION

This application is a continuation of and claims the priority of U.S. patent application Ser. No. 12/813,243, entitled "Beverage Container Authenticity and Provenance Devices and Methods," filed Jun. 10, 2010, now abandoned which is a continuation of U.S. application Ser. No. 12/035,803, entitled "Beverage Container Authenticity and Provenance Devices and Methods," filed Feb. 22, 2008, now abandoned and incorporates the same by reference.

BACKGROUND

The present disclosure relates to maintaining the authenticity and the preventing of counterfeiting of beverage containers.

SUMMARY

An RFID label and optional secondary security label ensures the authenticity of a beverage contained in a beverage container. The RFID label cannot be removed without destroying the RFID label or rendering it inoperable. The secondary security label may be placed over the closure of the beverage container to provide a secondary measure against tampering, as well as a visual indicator of authenticity. The secondary security label is placed on a portion of the bottle, a portion of the beverage container's closure, and a portion of the RFID label. An attempt to remove the secondary security label will also render the RFID label unusable.

According to a feature of the present disclosure, a device is disclosed comprising an RFID tag, comprising an RFID circuit and RFID antenna, permanently affixed in conjunction with a closure of a beverage container. The RFID tag is disposed in conjunction with the closure whereby the RFID tag is rendered inactive if the RFID antenna is damaged or severed from the RFID circuit.

According to a feature of the present disclosure, a method is disclosed comprising affixing an RFID label, comprising an RFID antenna and RFID circuit, to a wine or spirit bottle whereby removal of the capsule of the wine or spirit bottle renders the RFID label inoperative.

DRAWINGS

The above-mentioned features and objects of the present disclosure will become more apparent with reference to the following description taken in conjunction with the accompanying drawings wherein like reference numerals denote like elements and in which:

FIG. 1 is a perspective view of an embodiment of a beverage container authenticity and provenance device;

FIG. 2 is a perspective view of an embodiment of a beverage container authenticity and provenance device with a visual security member attached;

FIG. 3 is a perspective view of an embodiment of a case containing beverage containers having authenticity and provenance devices connected;

DETAILED DESCRIPTION

Figure 4:
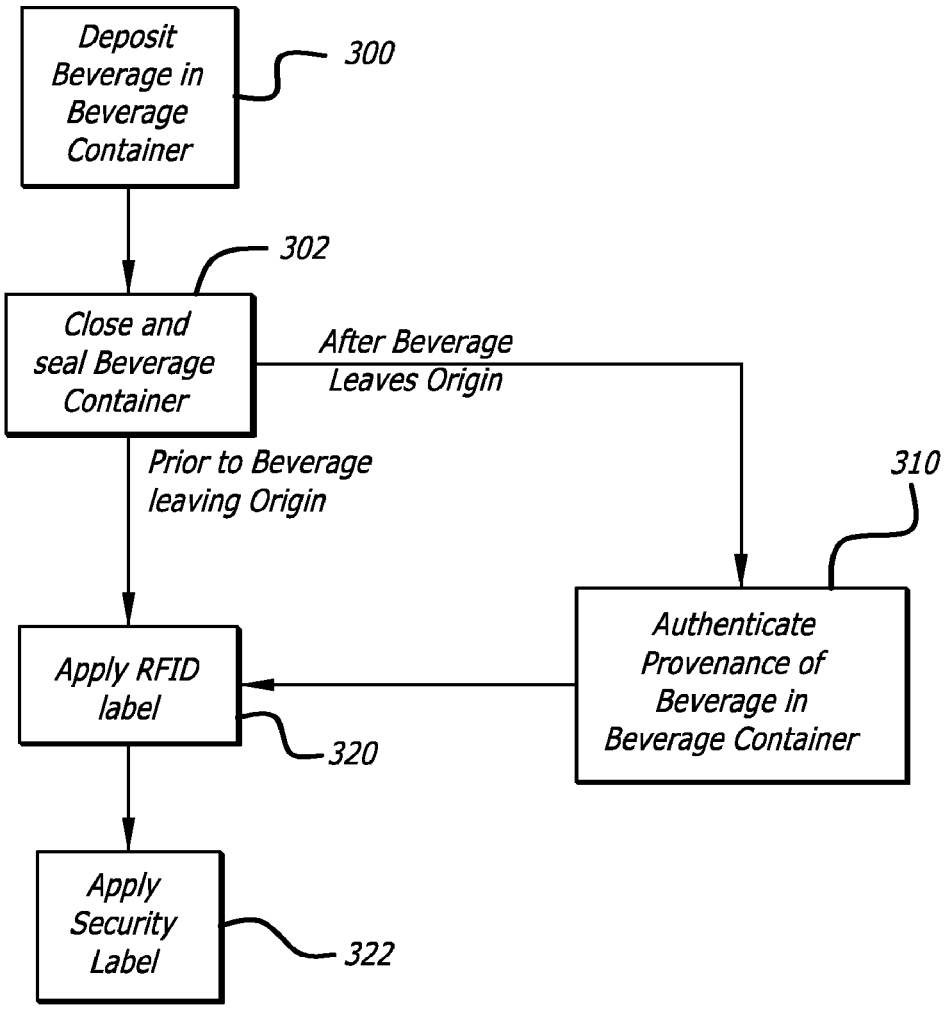
FIG. 4 is a flow diagram of an embodiment of the processes of authentication of application of an RFID label to a beverage container.

In the following detailed description of embodiments of the invention, reference is made to the accompanying drawings in which like references indicate similar elements, and in which is shown by way of illustration of specific embodiments in which the invention may be practiced. These embodiments are described in sufficient detail to enable those skilled in the art to practice the invention, and it is to be understood that other embodiments may be utilized and that logical, mechanical, biological, electrical, functional, and other changes may be made without departing from the scope of the present invention. The following detailed description is, therefore, not to be taken in a limiting sense, and the scope of the present invention is defined only by the appended claims. As used in the present disclosure, the term "or" shall be understood to be defined as a logical disjunction and shall not indicate an exclusive disjunction unless expressly indicated as such or notated as "xor."

This application also incorporates by reference U.S. Utility application Ser. No. 11/837,462 (U.S. Pat. Pub. 2008/0222003), filed 10 Aug. 2007; and U.S. Utility application Ser. No. 11/837,465 (U.S. Pat. Pub. 2008/0217404), filed 10 Aug. 2007.

As used herein, the term "RFID tag" and "RFID label" may be used interchangeably. RFID labels generally comprise a circuit or microchip and an antenna. As used herein "RFID tag" or "RFID label" may refer to any of passive, active, or semi-active RFID.

As used herein, the term "inactive" or "inoperable" as the terms apply to RFID labels mean that the RFID label is no longer capable of usefully transmitting data. Accordingly, the terms imply that the RFID label is no longer receiving signals from an RFID reader, that the RFID label cannot generate sufficient power to transmit data, or that the RFID label cannot transmit the data, etc.

As used herein, the term "affixed" as applied to the placement of RFID labels in conjunction with a beverage container means direct attachment to the beverage container or attachment to packaging, labels, or other component commonly used with beverage containers.

According to embodiments and as illustrated in FIG. 1, there is shown a security and authenticity labeling system to be used with beverage containers 100. Beverage containers 100 may comprise containers holding beverages, including bottles of all sizes, such as wine or spirit bottles, cans, carafes, and jars. Beverage containers 100 are closed or sealed as would be known to artisans, for example by screw top caps, corks and capsules, can tabs, perforated capsules (e.g., water bottle capsule lids), lids that affix by friction (e.g., the lid on a gallon of milk), etc. According to embodiments, where a bottle is used, capsule 120 is placed over beverage container opening that employ less secure methods of closing, for instance corks. According to embodiments, beverage container 100 comprising a wine bottle is corked after wine is put into it. After the closing of beverage container 100, capsule 120 is placed over the former opening of beverage container 100, covering the former opening as well as portion of beverage container neck 110. The devices used to close or seal beverage container 100 comprise the closure. For example, closure may comprise a cork and capsule 120. Alternatively, the closure may comprise a screw top or can tab, according to various embodiments.

To ensure authenticity and security and according to embodiments, RFID label 130 is permanently affixed to the closure of beverage container 100. RFID label 130 is also permanently affixed to at least one portion of beverage container 100 or beverage container neck 110. Thus, beverage container 100 cannot be opened without destroying or permanently disabling RFID label 130. RFID label 130 comprises an RFID circuit and RFID antenna integrated together and in electrical communication.

For example, beverage container 100 is a wine or spirit bottle. Beverage container 100 is corked at the winery and a capsule is placed over the cork and beverage container neck 110, as known and understood by artisans. RFID label 130 is then permanently affixed to capsule 120 and a portion of beverage container neck 110.

According to embodiments, RFID label 130 is a passive RFID device comprising at least an integrated circuit and an antenna, as known to artisans. According to embodiments, RFID label 130 may also be active or semi-active RFID devices. RFID label 130 is placed such that it is permanently affixed to a portion of beverage container neck 110 and placed onto capsule 120, thereby preventing removal of either the capsule or opening beverage container 100 without causing irreparable damage to RFID label 130. According to embodiments, RFID label 130 is permanently affixed to beverage container neck 110, placed across at least a portion of capsule 120, and to a second portion of beverage container neck 110, thereby preventing opening of beverage container 100 without removal of capsule 120.

According to embodiments, suitable adhesives, including epoxy-based adhesives or permanent pressure sensitive adhesives, are used to affix RFID label 130 to beverage container neck 110. Generally, the adhesive used prevents the label from being removed from beverage container 100 without damaging RFID label 130. The same or a different suitable adhesive is used to affix RFID label 130 to capsule 120.

According to embodiments and as illustrated in FIG. 2, security label 200 is affixed over closure 120, RFID label 130, beverage container neck 110. Placement of security label 200, according to embodiments, prevents access to the edges of the closure, for example the bottom of capsule 120 as illustrated in FIG. 2. Security label 200 adheres to capsule 120, beverage container neck 110, and optionally RFID label 130 via a suitable adhesive such as epoxy based adhesives or permanent pressure sensitive adhesives. According to embodiments, if security label 200 is removed, it will render RFID label 130 inoperative. Accordingly, the adhesive used to secure security label 200 will require more force to remove than the force necessary to cause damage to RFID label 130 upon removal of security label 200. Thus, removal of security label 200 will render RFID label 130 inoperative if it is removed from beverage container 100.

Naturally, the adhesive affixing security label 200 to beverage container 100 will be tamper-resistant, which will prevent removal of security label 200 using heat or chemical agents to degrade the adhesive. Not only will security label 200 render RFID label 130 inoperable upon removal, it also provides a visual confirmation as to whether the beverage container is authentic or whether it has been tampered with, etc.

According to embodiments, security label 200 is made from polyethylene terephthalate (PET) polyester (i.e., Mylar). According to embodiments, the PET selected is treated to make it "no-tear," for example by applying a layer of polyethylene to PET security label 200. PET security label 200 affixes to capsule 120, RFID label 130, and beverage container neck 110 such that the surface of the PET is smooth. If PET security label 200 is removed, it will "crumble" and be unable to be reapplied such that the surface is again smooth. Similarly, according to embodiments, an adhesive or chemical agent may be selected and applied under PET security label 200 that changes appearance if tampered with (e.g., heated or chemicals applied), thereby providing visual clues as to whether security label 200 has been tampered with.

According to embodiments, RFID labels 130 may be affixed in other locations. For example, RFID label 130 may be affixed over the top of a cork or within a cork on a wine bottle because the cork must be removed to consume the contents of the beverage container. However, as known in the art, corks are removable without corkscrews; thus, RFID labels 130 affixed to the top or inside of a cork would be able to be removed without rendering RFID label 130 inoperative. According to embodiments, PET security label 200 is affixed over cork and beverage container neck 110, whereby removal of PET security label provides either the visual indicia of tampering or cannot be replaced in its original smooth conformation, as described above.

According to embodiments and as illustrated in FIG. 3, beverage containers 100 having RFID labels 130 affixed may be packaged in cases 140 for shipment. Each case 140 may have RFID label 130 affixed. Thus, retailers, wholesalers, and consumers can readily determine, based on a correlation of data either stored on RFID label 130 affixed to case 140 or by using an electronic product code embedded in RFID label 130 affixed to case 140 whether the correct individual beverage containers 100 are contained in each case 140. Thus, one can readily determine if tampering has occurred not only with single beverage containers 100, but also by evaluating the contents of each case 140.

Figure 5:
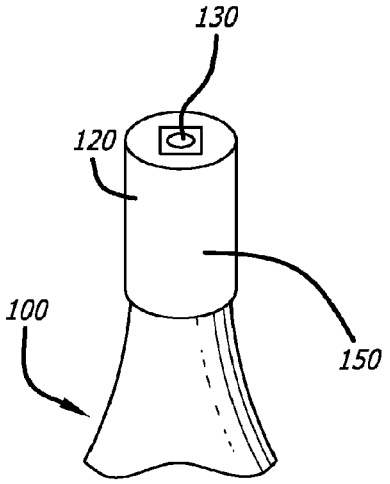
FIG. 5 is a perspective view of an embodiment of an RFID antenna system affixed to a beverage container where the antenna is a monopole antenna.

According to embodiments, RFID antenna 150 is formed on or in capsule 110 and suitably connected with RFID circuit 145. As illustrated in FIG. 5, capsule 120 is made of a conductive foil, such as aluminum foil, tin foil, or gold foil, for example, and itself comprises a monopole RFID antenna 150 to which is in electric communication with RFID label 130. Thus, no separate RFID antenna 150 apart from capsule 120 itself is necessary.

Figure 6A:
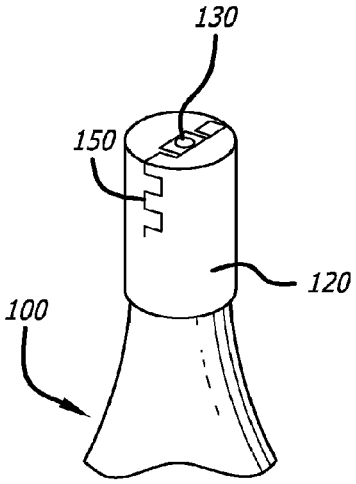
FIGS. 6A and 6B are perspective views of embodiments of an RFID antenna system affixed to a beverage container where the antenna comprises a pattern of conductive material.
Figure 6B:
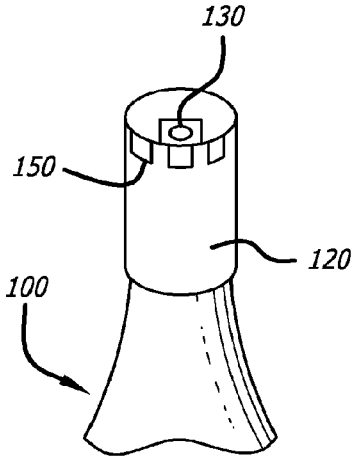

According to other embodiments, and as shown in FIGS. 6A and 6B, RFID antenna 150 may be installed on capsule 120 as a separate component of RFID label 120 in conjunction with RFID circuit 145. Accordingly and as shown by the exemplary embodiment of FIG. 6, RFID antenna 150 is etched into one or both sides (or top or under) of capsule 120. An advantage of having RFID antenna 150 under capsule 120 is that consumers are unable to ascertain where RFID antenna 150 is located and thereby intentionally avoid breaking RFID antenna 150 upon opening beverage containers 100.

According to the embodiments illustrated by FIGS. 6A and 6B, capsule 120 therefore need not be made from a conductive material. Rather it may be made from plastic or other non-conductive polymers, for example. According to embodiments, RFID antenna 150 may be masked on or comprise a pre-made RFID antenna affixed with an adhesive.

According to embodiments as illustrated by FIGS. 6A and 6B, RFID antenna 150 may be placed in virtually limitless configurations. As illustrated in FIG. 6A, RFID antenna 150 is placed parallel to the long axis of beverage container 100. As illustrated in FIG. 6B, RFID antenna 150 is placed perpendicular to the long axis of beverage container 100. According to still other embodiments not shown, RFID antenna 150 may be situated at any other angles with respect to the long axis of beverage container 100, or a combination of angles, including perpendicular and parallel.

According to embodiments, RFID antenna 150 is etched onto capsule 200, as would be known and understood by artisans. Alternatively, RFID antenna 150 may be applied as a mask similar to the masking of microelectronics. In all cases, when capsule is removed, RFID antenna 150 is destroyed by severing RFID antenna 150 from RFID circuit 145 or by damaging the antenna and preventing the receipt of signals from an RFID reader, preventing the generation of sufficient power to transmit, or by eliminating the ability to transmit a signal thereby rendering RFID label 130 inoperative.

According to embodiments, RFID antenna 150 is rendered inoperative by affixing capsule 120 with a strong adhesive and in such a way that removing capsule 120 separates RFID circuit 145 from RFID antenna 150. Thus, potential counterfeiters are unable to remove capsule 120 without rendering RFID label 130 inoperative. For example, RFID antenna 150 is connected near the top of capsule 120 and affixed with an adhesive at the end to beverage container 100 and at the point where it connects with RFID label 130 to capsule 120. Thus, it would be impossible to remove capsule 120 from beverage container 100 without destroying RFID antenna 150 and thereby rendering RFID label 150 inoperative because during the removal process the end of RFID antenna 150 will remain affixed to beverage container 100 and the portion of RFID antenna 150 closest to RFID circuit 145 is removed together with capsule 120.

According to similar embodiments, RFID circuit 145 may be affixed to capsule 120 and RFID antenna 150 substantially affixed to beverage container 100. Thus, when capsule 120 is removed, RFID circuit 145 is separated from RFID antenna 150, thereby rendering RFID label inoperative. The opposite configuration may also be used. In both cases, the adhesive must be stronger than the force required to break or damage the RFID antenna 150 to ensure that when capsule 120 is removed the portion of RFID label 130 affixed to beverage container 100 is not removed with capsule 120.

The present disclosure discloses methods of providing a tool for ensuring authenticity of beverages contained in beverage containers as illustrated in FIG. 4. According to embodiments, an RFID label is applied to beverage container to ensure authenticity and provenance of the contents of the beverage container over the course of time. The RFID labels may be applied either at the origin of the beverage or at a later time and location.

Placement of an RFID label and security label, according to embodiments, are applied at the point of origin. After the beverage is deposited in the beverage container in operation 300 and the beverage container is closed and sealed using the closure device in operation 302, the RFID label is applied over the closure and at least a portion of the beverage container in operation 320, as described in detail above. Optionally, according to embodiments, security label is applied over at least a portion of the RFID label in operation 322, as described in detail above. An adhesive is used to ensure the RFID label and security label cannot be removed without destroying or rendering inoperable the RFID label, according to embodiments. Thus, the closure cannot be removed without destroying the RFID label, and the RFID label cannot be removed without destroying it. Moreover, the RFID label cannot be easily removed and applied to counterfeit beverages. According to similar embodiments, security label changes appearance if removed or tampered with.

Placement of an RFID label, and optionally a security label, may be applied after the beverage has departed from its point of origin, according to embodiments. Prior to applying the RFID label, the beverage contained in the beverage container is authenticated in operation 310. Thereafter, the RFID label and security labels are applied in operations 320, 322.

For example, an aged wine originated prior to the advent of RFID technologies. According to embodiments, an expert authenticates the aged bottle of wine as genuine, after which an RFID label is applied as disclosed herein. Thus, after a particular beverage is deemed to be authentic, the RFID label provides continuing assurance that the particular bottle is genuine, as well as records provenance data from that point on.

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A method comprising:

integrating an RFID label, the RFID label comprising an RFID circuit and an antenna and being directly rendered inoperable when subject to a first level of force, into the capsule of a wine or spirits bottle by one of etching the antenna into the capsule or masking the antenna into the capsule;

affixing a security label over the capsule and the bottle using an adhesive, whereby the RFID label is directly inactivated by removal of the security label, the adhesive requiring a second level of force to remove, the second level of force being greater than the first level of force;

wherein when the capsule is removed, the security label causes tearing of the capsule and at least a first portion of the capsule affixed with the security label remains with the security label and a second portion of the capsule is removed, whereby the first portion and the second portion are separated from each other;

wherein when the first portion is separated from the second portion, the RFID label is rendered inoperable.

2. The device of claim 1, wherein the security label or a chemical agent associated with the security label with a first visual appearance assumes a second visual appearance if the security label is tampered with or removed.

3. The device of claim 1, wherein the RFID label is affixed to the bottle at least two locations to prevent removal of the closure or security label without rendering the security label inoperable.

4. The device of claim 1, wherein the RFID antenna is a monopole antenna comprising substantially the entire capsule.

5. The device of claim 1, wherein the RFID antenna is etched into the capsule.

6. The device of claim 1, wherein the RFID antenna is applied by a mask into the capsule.

7. The device of claim 1, wherein one of the RFID circuit or the RFID antenna is affixed to the wine bottle and the other of the RFID circuit and the RFID antenna is substantially affixed to the capsule, whereby removal of the capsule severs the RFID antenna from the RFID circuit rendering the RFID tag inoperable.

8. The method of claim 1, wherein the capsule comprises a monopole RFID antenna.

* * * * *